US008939131B2

(12) United States Patent
Murakami

(10) Patent No.: US 8,939,131 B2
(45) Date of Patent: Jan. 27, 2015

(54) PCV VALVE APPARATUS

(71) Applicant: Honda Motor Co., Ltd., Tokyo (JP)

(72) Inventor: Hiroyasu Murakami, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/135,582

(22) Filed: Dec. 20, 2013

(65) Prior Publication Data

US 2014/0174415 A1 Jun. 26, 2014

(30) Foreign Application Priority Data

Dec. 26, 2012 (JP) ..... 2012-283664

(51) Int. Cl.
*F01M 13/00* (2006.01)
*F01M 13/04* (2006.01)

(52) U.S. Cl.
CPC ..... *F01M 13/0416* (2013.01); *F01M 13/00* (2013.01); *F01M 13/0405* (2013.01); *F01M 13/04* (2013.01)
USPC ..... 123/574; 123/572

(58) Field of Classification Search
CPC ... F01M 13/04; F01M 13/0405; F01M 13/00; F01M 13/0416; F01M 2013/0461
USPC ..... 123/572, 574
See application file for complete search history.

(56) References Cited

U.S. PATENT DOCUMENTS 6,530,367 B2 * 3/2003 Akiwa et al. ..... 123/572

FOREIGN PATENT DOCUMENTS

JP 2010-121537 6/2010
JP 2012-188942 10/2012

* cited by examiner

*Primary Examiner* — Lindsay Low
*Assistant Examiner* — Kevin Lathers
(74) *Attorney, Agent, or Firm* — Mori & Ward, LLP

(57) ABSTRACT

A PCV valve apparatus includes a PCV valve main body and a cover member. The PCV valve main body includes a first connection portion, a second connection portion, and a fastened portion. The first connection portion includes a first end and a second end. The cover member includes an attachment portion and a covering portion. The fastened portion includes a locking portion protruding toward the cover member in a state where the covering portion covers a fastening member. In a covering position where the covering portion covers the fastening member, the locking portion is received in a receiving portion, and the attachment portion is located at the second end. In a non-covering position where the covering portion does not cover the fastening member, the attachment portion is in contact with the locking portion to be locked by the locking portion and is located at the first end.

7 Claims, 11 Drawing Sheets

BACKGROUND ART

PCV VALVE APPARATUS

CROSS-REFERENCE TO RELATED APPLICATIONS

The present application claims priority under 35 U.S.C. §119 to Japanese Patent Application No. 2012-283664, filed Dec. 26, 2012, entitled "PCV Valve Apparatus." The contents of this application are incorporated herein by reference in their entirety.

BACKGROUND

1. Field

The present disclosure relates to a PCV valve apparatus.

2. Description of the Related Art

When an engine is in operation, unburned gas leaks through the gap between the piston and the cylinder to the crank case, and becomes gas containing moisture, oil mist, and so forth in the crank case, that is, so-called "blow-by gas" is generated. Releasing this blow-by gas directly into the atmosphere causes air pollution. So, an engine is provided with a positive crankcase ventilation (PCV) apparatus for separating oil mist and so forth from blow-by gas, then returning the blow-by gas to the intake system, sending the blow-by gas into the combustion chamber, and burning the blow-by gas. The release of blow-by gas into the atmosphere is thereby suppressed.

The PCV apparatus includes a PCV valve apparatus and a PCV pipe. The PCV valve apparatus is attached to an engine main body (for example, a cylinder head cover), and regulates the amount of blow-by gas returned to the intake system using intake negative pressure. The PCV pipe is connected to the downstream end of the PCV valve apparatus, and connects the PCV valve apparatus and the intake system. The PCV pipe has a function of leading blow-by gas led out from the PCV valve apparatus to the intake system. The intake system is provided with a flow rate sensor that detects the flow rate of fluid flowing through the intake system.

SUMMARY

According to one aspect of the present invention, a PCV valve apparatus includes a PCV valve main body and a cover member. The PCV valve main body includes a first connection portion, a second connection portion, and a fastened portion. The first connection portion includes a first end and a second end. The first end is to be provided in a PCV pipe provided to lead blow-by gas to an intake system. The second connection portion is provided at the second end of the first connection portion to be connected to an internal combustion engine main body. The fastened portion protrudes from an outer surface of the second connection portion in a first direction to be fixed to the internal combustion engine main body by a fastening member. The first direction intersects with the second connection portion. The cover member includes an attachment portion and a covering portion. The attachment portion includes an insertion hole in which the first connection portion is provided and which is disposed closer to the second connection portion than the PCV pipe. The covering portion is to cover the fastening member. The cover member is configured such that, when the covering portion is moved along the first connection portion to a position to remove the fastening member, the attachment portion pushes the PCV pipe out of the first connection portion. The fastened portion includes a locking portion protruding toward the cover member in a state where the covering portion covers the fastening member. The covering portion includes a receiving portion to receive the locking portion. In a covering position where the covering portion covers the fastening member, the locking portion is received in the receiving portion, and the attachment portion is located at the second end of the first connection portion. In a non-covering position where the covering portion does not cover the fastening member, the attachment portion is in contact with the locking portion to be locked by the locking portion and is located at the first end of the first connection portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

At the time of maintenance of an engine, the PCV valve apparatus is removed from the cylinder head cover with the PCV pipe connected to the PCV valve apparatus, and the cylinder head cover is removed from the cylinder head. After the inside of the engine is maintained or inspected, the cylinder head cover is attached to the cylinder head again. At this time, one may forget to attach the PCV valve apparatus to the cylinder head cover.

In this case, since the PCV valve apparatus is connected to the PCV pipe, a predetermined amount of air is introduced through the PCV pipe into the intake system when the engine is operated. Therefore, the engine operates normally, and it is difficult to detect abnormality with the flow rate sensor of the intake system. Therefore, the vehicle is used with the PCV valve apparatus not attached to the cylinder head cover, and blow-by gas is released from the cylinder head cover into the atmosphere.

Figure 9:
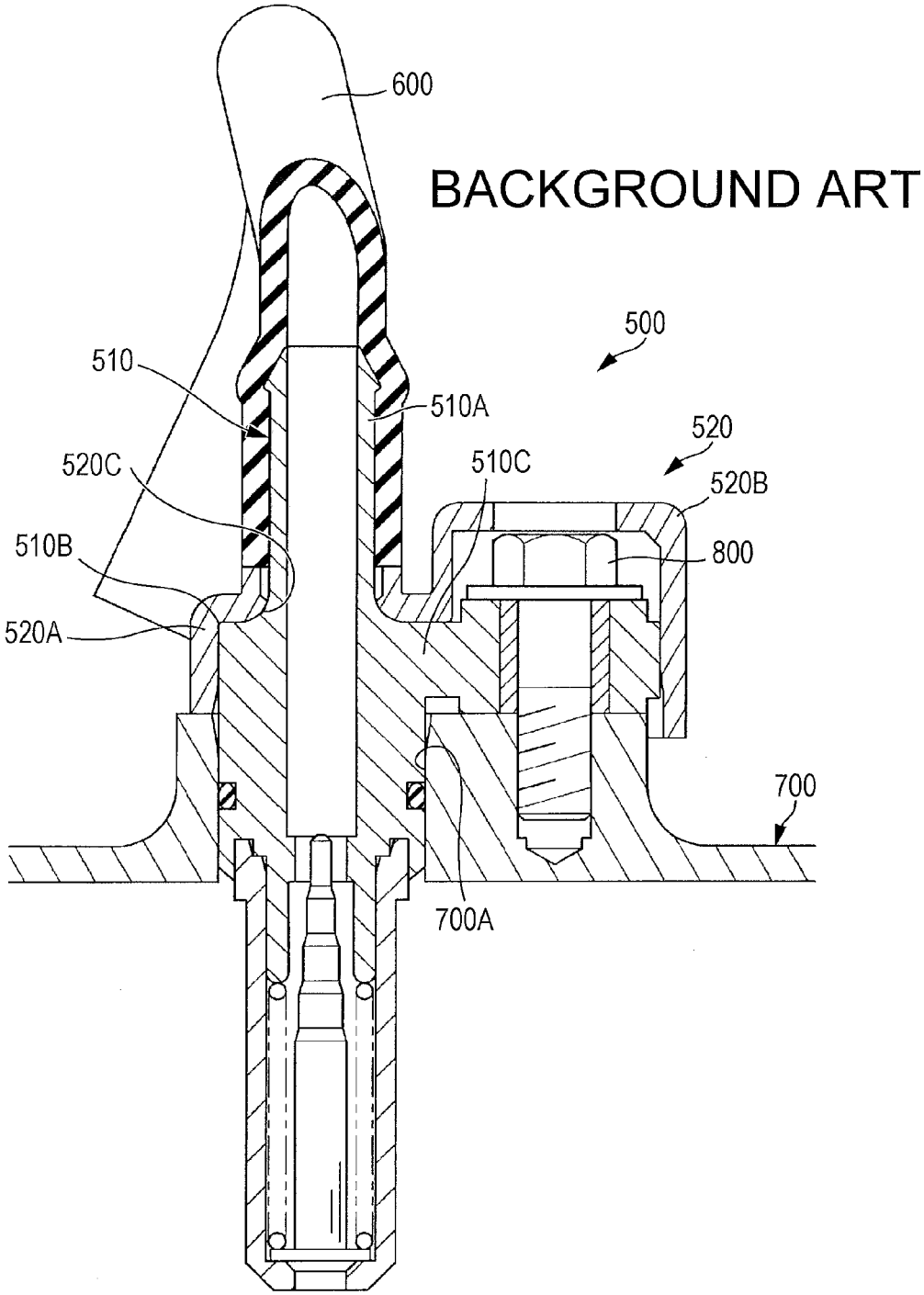
FIG. 9 is a longitudinal sectional view showing a PCV valve apparatus and PCV pipe according to a related art.
Figure 10:
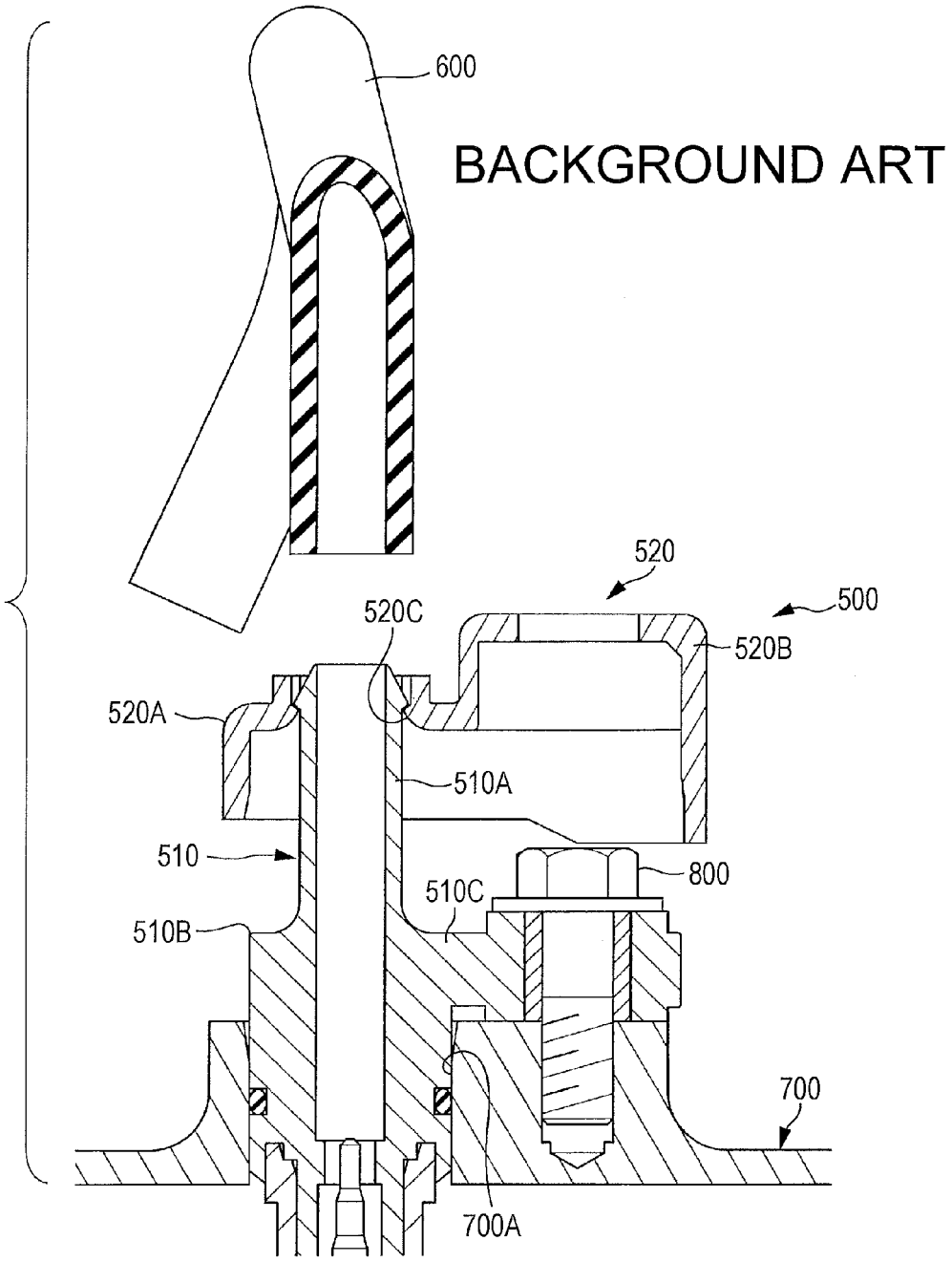
FIG. 10 is a longitudinal sectional view for illustrating the process of removing the PCV valve apparatus and PCV pipe according to the related art.
Figure 11:
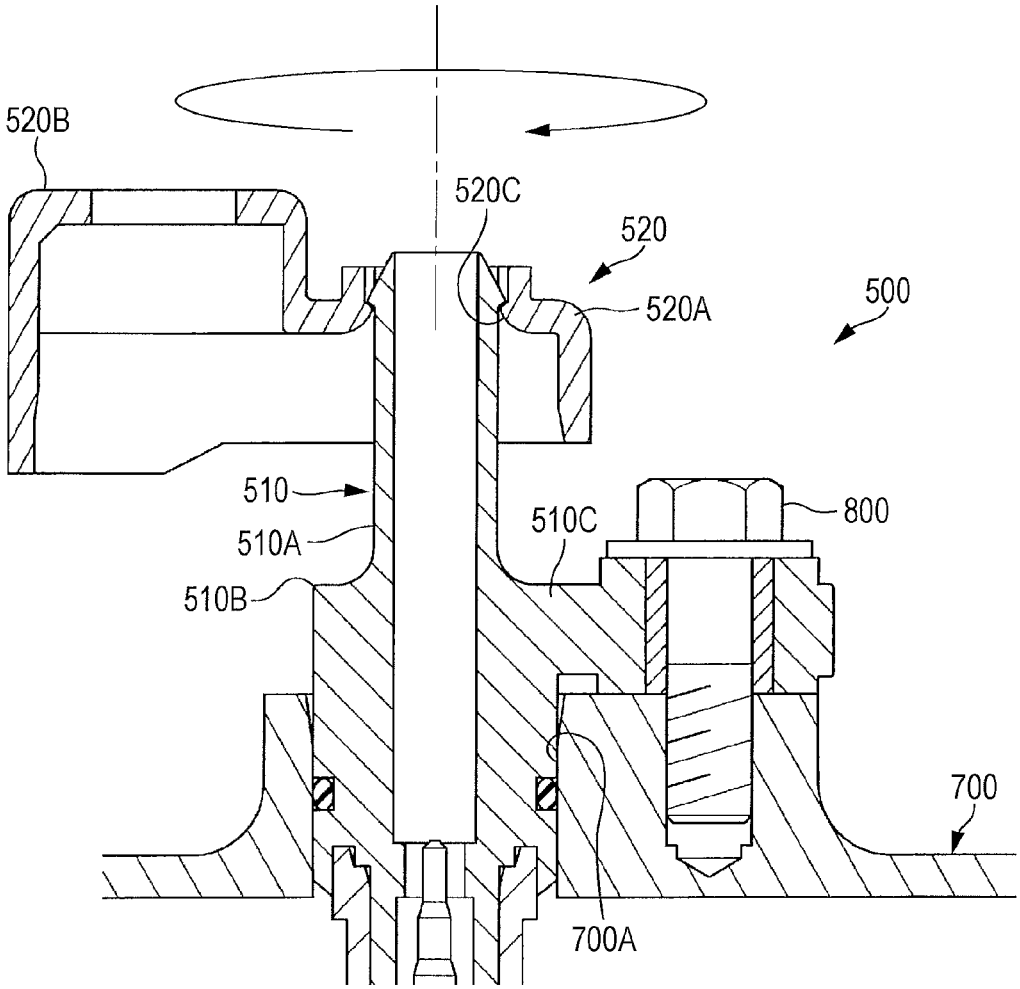
FIG. 11 is a longitudinal sectional view for illustrating the process of removing the PCV valve apparatus and PCV pipe according to the related art.

In order to solve such a problem, a PCV valve apparatus that cannot be removed from the cylinder head cover with the PCV pipe connected to the PCV valve apparatus has been proposed (see Japanese Unexamined Patent Application Publication No. 2012-188942). FIG. 9 is a longitudinal sectional view showing a PCV valve apparatus and PCV pipe according to a related art. FIG. 10 and FIG. 11 are longitudinal sectional views for illustrating the process of removing the PCV valve apparatus and PCV pipe according to the related art.

As shown in FIG. 9, a PCV valve apparatus 500 includes a PCV valve main body 510 and a cover member 520. The PCV valve main body 510 has a first connection portion 510A, a second connection portion 510B, and a fastened portion 510C. The first connection portion 510A is inserted into a PCV pipe 600. The second connection portion 510B is provided at the lower end of the first connection portion 510A. The lower end of the second connection portion 510B is inserted into an insertion hole 700A of a cylinder head cover 700. The fastened portion 510C protrudes radially outward from the outer peripheral surface of the second connection portion 510B and is fixed to the cylinder head cover 700 with a bolt 800. The cover member 520 has an attachment portion 520A and a covering portion 520B. The attachment portion 520A is provided with an insertion hole 520C into which the first connection portion 510A is inserted. The attachment portion 520A is disposed closer to the second connection portion 510B than the PCV pipe 600. The covering portion 520B covers the bolt 800.

As shown in FIG. 10, the cover member 520 is configured such that the attachment portion 520A pushes the PCV pipe 600 out of the first connection portion 510A when the covering portion 520B is moved to a position where the bolt 800 can be removed. As shown in FIG. 11, the cover member 520 is rotated about the axis of the first connection portion 510A and the covering portion 520B is moved from the position over the bolt 800 so that the bolt 800 can be removed.

Owing to such a configuration, in a state where the bolt 800 can be removed, the PCV pipe 600 is removed from the first connection portion 510A. That is, in a state where the PCV valve main body 510 is removed from the cylinder head cover 700, the PCV pipe 600 is removed from the PCV valve main body 510.

After the inside of an engine is maintained or inspected, the cylinder head cover is attached to the cylinder head again. At this time, if one forgets to attach the PCV pipe 600 to the PCV valve main body 510, the PCV pipe 600 is removed from the PCV valve main body 510. Therefore, when the engine is operated, a large amount of air is introduced through the PCV pipe 600 into the intake system, and the abnormality in the amount of intake air can be detected with a flow rate sensor provided in the intake system. Therefore, a state where the PCV pipe 600 is not connected to the PCV valve main body 510 can be rapidly detected, and the release of blow-by gas from the cylinder head cover 700 into the atmosphere can be suppressed.

However, in the structure of Japanese Unexamined Patent Application Publication No. 2012-188942, it is possible to attach the cover member 520 to the PCV valve main body 510 such that the covering portion 520B does not cover the bolt 800 with the cover member 520 rotated (see FIG. 11). If the cover member 520 is wrongly attached in such a manner, the PCV valve apparatus 500 can be removed from the cylinder head cover 700 with the PCV pipe 600 connected to the PCV valve apparatus 500 at the time of the next maintenance.

The embodiments will now be described with reference to the accompanying drawings, wherein like reference numerals designate corresponding or identical elements throughout the various drawings.

In this embodiment, a description will be given of a case where a PCV valve apparatus of the present disclosure is fixed to the upper surface of a cylinder head cover as an internal combustion engine main body. However, the installation location of the PCV valve apparatus is not limited to this. In the description, the words "top", "bottom", "left", and "right" designate directions indicated by arrows in FIG. 2.

Figure 1:
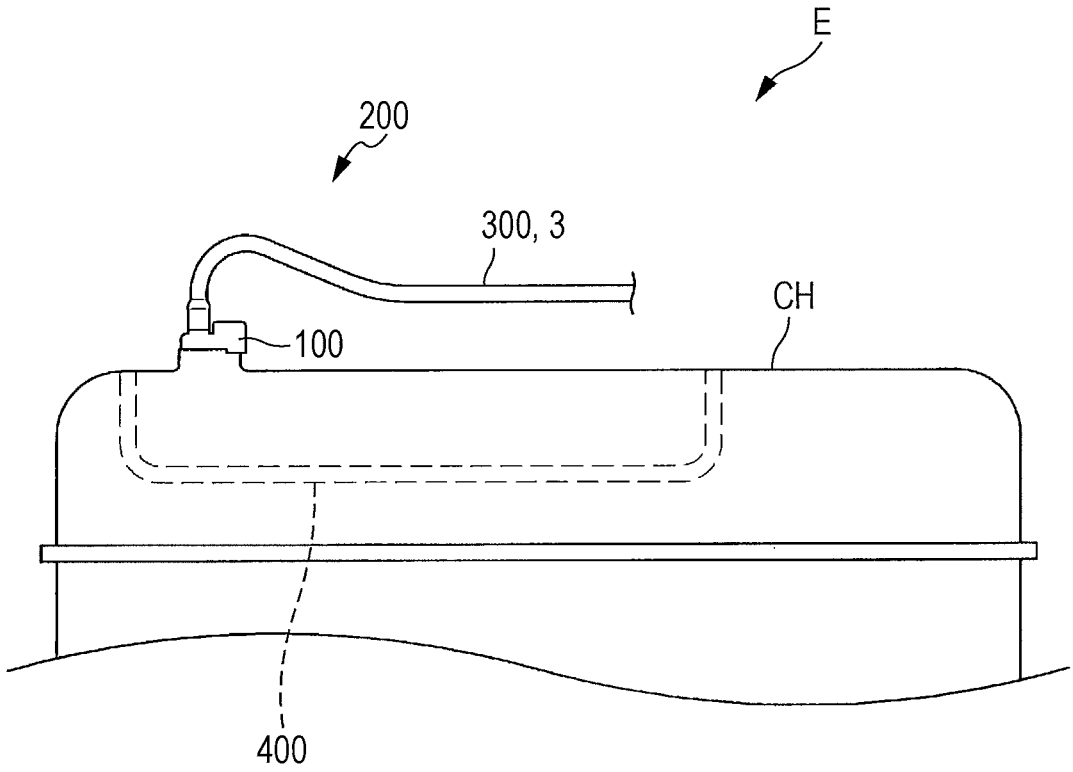
FIG. 1 is a schematic side view of an engine equipped with a PCV valve apparatus according to the embodiment of the present disclosure.

FIG. 1 is a schematic side view of an engine equipped with a PCV valve apparatus according to the embodiment of the present disclosure. As shown in FIG. 1, an engine E is equipped with a PCV apparatus 200 for returning blow-by gas to an intake system (not shown). The PCV apparatus 200 mainly includes a return passage 300, a gas-liquid separator 400, and a PCV valve apparatus 100. The return passage 300 leads from a crank case (not shown) to the intake system. The gas-liquid separator 400 is provided in the middle of the return passage 300, and separates oil mist from blow-by gas. The PCV valve apparatus 100 is provided on the downstream side of the gas-liquid separator 400. Reference sign 3 of FIG. 1 denotes a PCV pipe that forms a part of the return passage 300 and that is connected to the downstream side of the PCV valve apparatus 100 at one end and is connected to the intake system at the other end. The PCV pipe 3 may be selected from known PCV pipes, and is, for example, a rubber hose. The intake system is provided with a flow rate sensor (not shown) that detects the flow rate of fluid flowing through the intake system.

Figure 2:
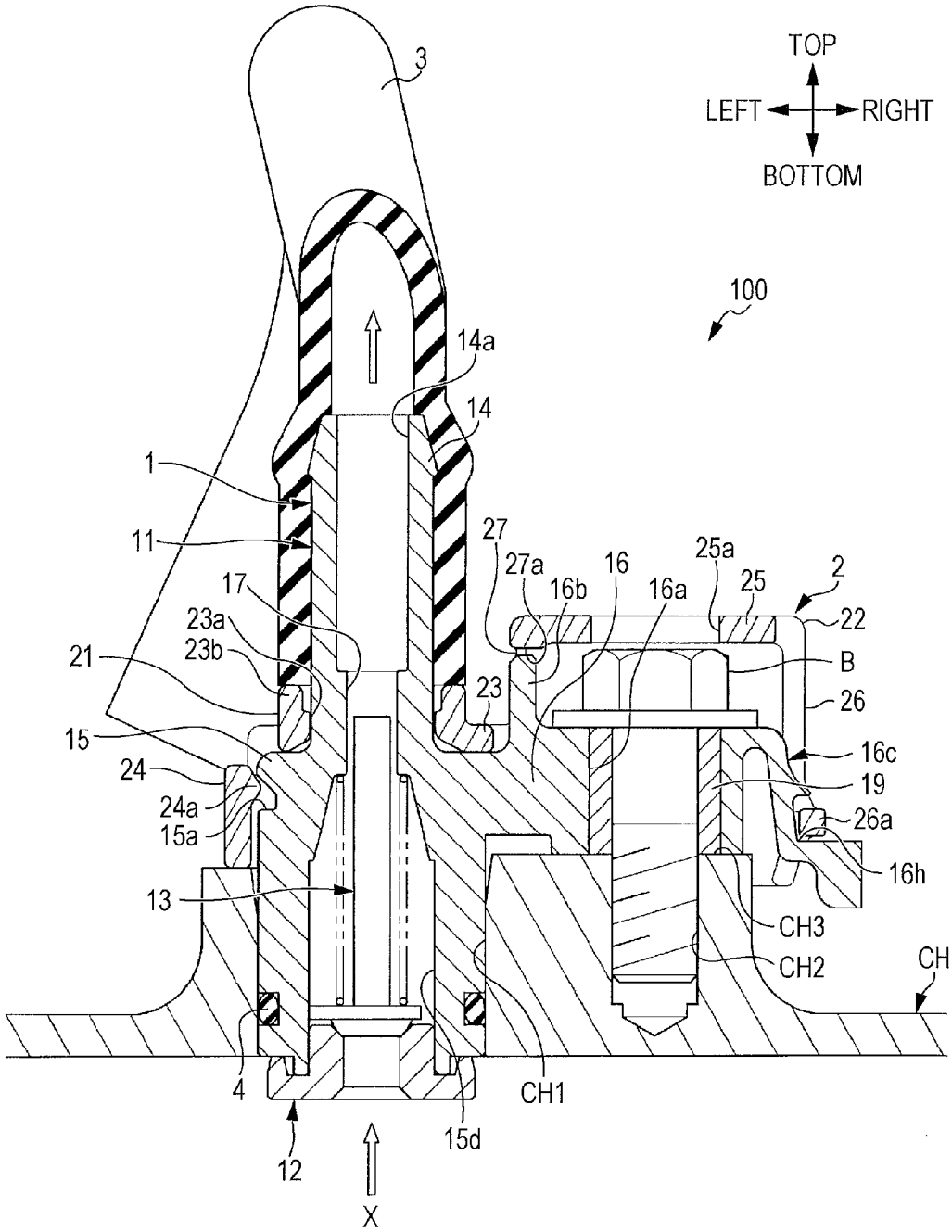
FIG. 2 is a longitudinal sectional view showing the PCV valve apparatus and PCV pipe.
Figure 3A:
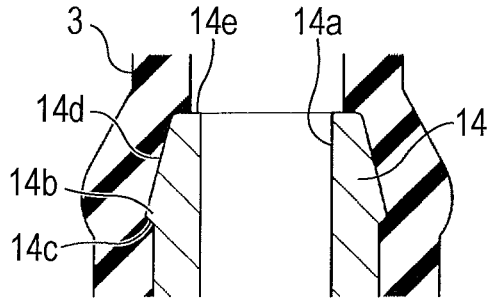
FIG. 3A is a partial enlarged longitudinal sectional view showing the upper end of the PCV valve apparatus shown in FIG. 2.
Figure 3B:
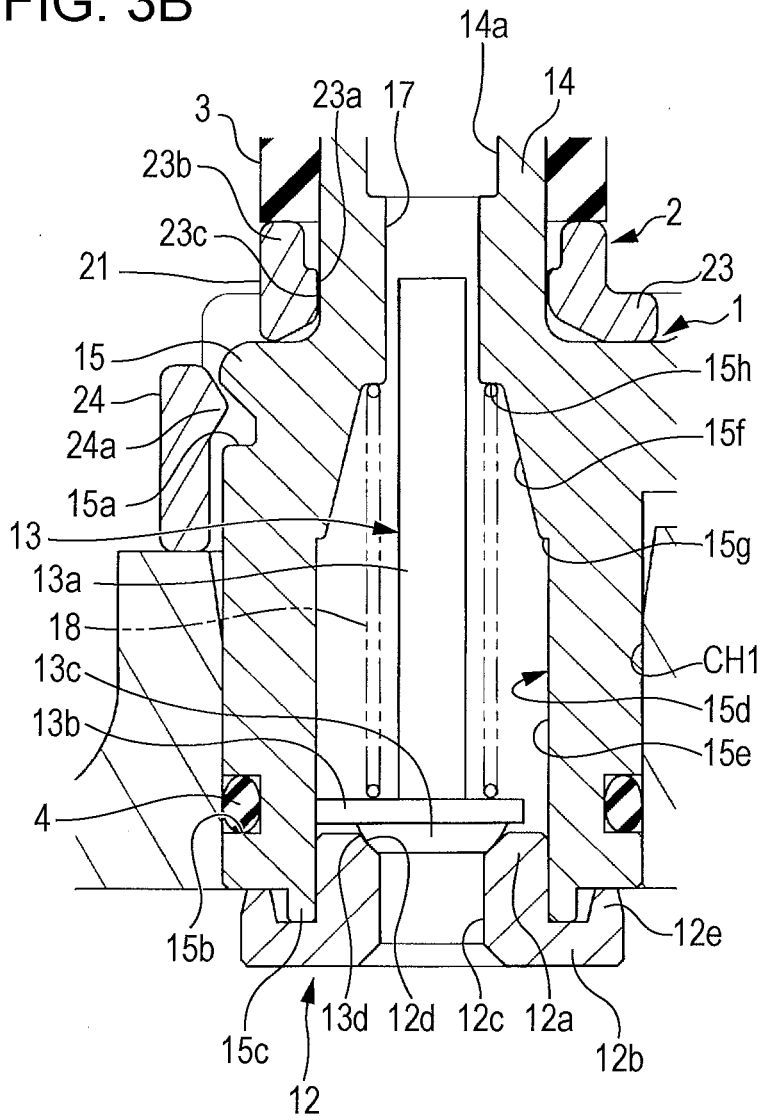
FIG. 3B is a partial enlarged longitudinal sectional view showing the lower end of the PCV valve apparatus shown in FIG. 2.
Figure 4:
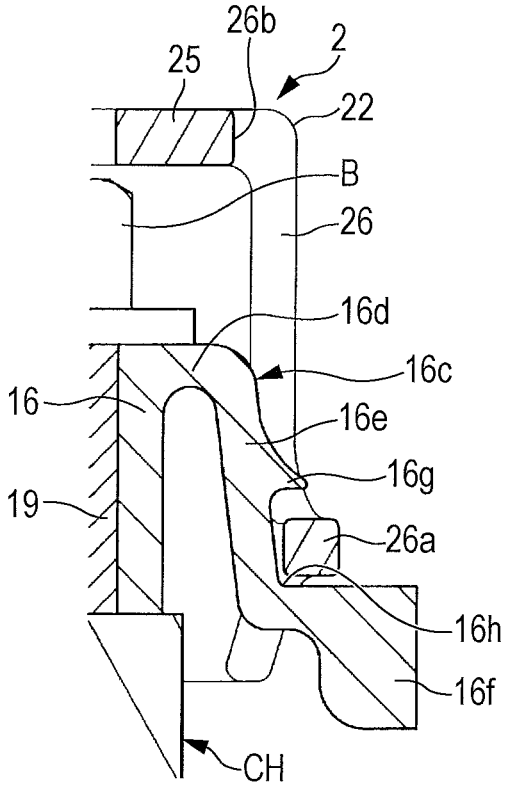
FIG. 4 is a partial enlarged longitudinal sectional view showing the right end of the PCV valve apparatus shown in FIG. 2.

FIG. 2 is a longitudinal sectional view showing the PCV valve apparatus and PCV pipe. FIG. 3A is a partial enlarged longitudinal sectional view showing the upper end of the PCV valve apparatus shown in FIG. 2, and FIG. 3B is a partial enlarged longitudinal sectional view showing the lower end of the PCV valve apparatus shown in FIG. 2. FIG. 4 is a partial enlarged longitudinal sectional view showing the right end of the PCV valve apparatus shown in FIG. 2. The arrow X of FIG. 2 indicates the direction in which blow-by gas flows. As shown in FIG. 2, the PCV valve apparatus 100 includes a PCV valve main body 1 and a cover member 2.

PCV Valve Main Body

The PCV valve main body 1 is a member that is installed between the gas-liquid separator 400 (see FIG. 1) and the PCV pipe 3 and that regulates the amount of returned blow-by gas using intake negative pressure. The PCV valve main body 1 has a valve body 11, a holding member 12, and a valving element 13.

Valve Body

The valve body 11 is a member formed, for example, of a resin material, and has a first connection portion 14, a second connection portion 15, and a fastened portion 16. An attachment portion 21 (to be described later) of the cover member 2 and the PCV pipe 3 are connected (attached) to the first connection portion 14. The second connection portion 15 is provided at the lower end of the first connection portion 14, and is connected to the cylinder head cover CH. The fastened portion 16 is formed so as to protrude radially outward from the outer peripheral surface of the upper end of the second connection portion 15, and is fastened to the cylinder head cover CH.

First Connection Portion

The first connection portion 14 is a hollow cylindrical portion that is exposed to the outside of the cylinder head cover CH and that is inserted into the PCV pipe 3. The first connection portion 14 has a lead-out hole 14*a* formed therein. The lead-out hole 14*a* leads out blow-by gas to the PCV pipe 3. The lead-out hole 14*a* is formed so as to extend downward from the upper end of the first connection portion 14 along the axial direction and so as to have a constant internal diameter. As shown in FIG. 3A, an increased diameter portion 14*b* is formed on the outer peripheral surface of the upper end of the first connection portion 14 so as to have a diameter greater than those of other portions. The increased diameter portion 14*b* has a locked surface 14*c* formed so as to gradually increase in diameter upward. A tapered surface 14*d* is formed on the outer periphery of the upper end of the first connection portion 14 so as to gradually decrease in diameter upward from the upper end of the locked surface 14*c*. The tapered surface 14*d* corresponds to a tapered portion.

Although, in this embodiment, the increased diameter portion 14*b* is formed integrally with the first connection portion 14, the increased diameter portion 14*b* may be formed separately from the first connection portion 14 and may be fixed to the first connection portion 14.

Second Connection Portion

As shown in FIG. 2, the second connection portion 15 is a hollow cylindrical portion the lower end of which is inserted into an insertion hole CH1 formed in the cylinder head cover CH. The second connection portion 15 is formed coaxially with the first connection portion 14, and is formed so as to have an external diameter greater than the external diameter of the first connection portion 14. As shown in FIG. 3B, a first recess 15*a* is formed in the outer peripheral surface of the upper end of the second connection portion 15. A first engaging portion 24*a* (to be described later) engages with the first recess 15*a*. The first recess 15*a* and the first engaging portion 24*a* will be described in detail later. A seal member 4 is attached to the outer peripheral surface of the lower end of the second connection portion 15, with an annular groove 15*b* therebetween. Thus, the seal member 4 is held between the second connection portion 15 and the cylinder head cover CH, and the space between the second connection portion 15 and the cylinder head cover CH is held in an air-tight or liquid-tight state. An annular protruding portion 15*c* is formed on the inner peripheral side of the lower end of the second connection portion 15 so as to protrude downward.

The second connection portion 15 has an introduction hole 15*d* formed therein. Blow-by gas passing through the gas-liquid separator 400 is introduced into the introduction hole 15*d*. The introduction hole 15*d* is connected with the lead-out hole 14*a* by a communication hole 17 formed so as to be smaller in diameter than the introduction hole 15*d*. The communication hole 17 is formed so as to straddle the border between the first connection portion 14 and the second connection portion 15. The introduction hole 15*d* has a hollow cylindrical surface 15*e*, a tapered surface 15*f*, a first stepped surface 15*g*, and a second stepped surface 15*h*. The hollow cylindrical surface 15*e* is formed so as to extend upward from the lower end of the second connection portion 15 along the axial direction and so as to have a constant internal diameter. The tapered surface 15*f* is formed so as to be smaller in diameter than the hollow cylindrical surface 15*e* and gradually decreases in diameter upward. The first stepped surface 15*g* extends along the radial direction and connects the hollow cylindrical surface 15*e* and the tapered surface 15*f*. The second stepped surface 15*h* extends along the radial direction and connects the tapered surface 15*f* and the inner peripheral surface of the communication hole 17. The second stepped surface 15*h* functions as a spring bearing portion that supports the upper end of a return spring to be described later.

Fastened Portion

As shown in FIG. 2, the fastened portion 16 is a portion that is fastened to the cylinder head cover CH with a bolt B. The fastened portion 16 has a bolt insertion hole 16*a* formed vertically therethrough. A hollow cylindrical collar member 19 is disposed in the bolt insertion hole 16*a*. The bolt B is inserted into the bolt insertion hole 16*a* (the collar member 19) and a bolt insertion hole CH2 of the cylinder head cover CH, and the PCV valve main body 1 is fixed to the upper surface CH3 of the cylinder head cover CH with the bolt B. A locking portion 16*b* is formed at the upper end of the fastened portion 16 so as to protrude upward (toward the cover member 2). The locking portion 16*b* is provided closer to the first connection portion 14 than the bolt insertion hole 16*a*. The locking portion 16*b* has a function of coming into contact with and locking the attachment portion 21 in a state where the covering portion 22 does not cover the bolt B as will be described later (see FIG. 6). The attachment portion 21 is thereby located at the upper end of the first connection portion 14, and therefore the connection of the PCV pipe 3 to the first connection portion 14 can be prevented. An engaging portion 16*c* is formed on the outer peripheral surface of the fastened portion 16. A second engaging portion 26*a* (to be described later) engages with the engaging portion 16*c*. The engaging portion 16*c* and the second engaging portion 26*a* will be described in detail later.

Holding Member

As shown in FIG. 3B, the holding member 12 is a hollow cylindrical member made of resin for holding the valving element 13. The holding member 12 has an insertion portion 12*a* and a flange portion 12*b*. The insertion portion 12*a* extends along the axial direction of the introduction hole 15*d* and is inserted into the introduction hole 15*d*. The flange portion 12*b* protrudes radially outward from the outer peripheral surface of the lower end of the insertion portion 12*a*.

The insertion portion 12*a* has a hole portion 12*c* formed therethrough coaxially with the introduction hole 15*d*. A valve seat surface 12*d* is formed on the inner peripheral surface of the upper end of the insertion portion 12*a*. A seat portion 13*d* of the valving element 13 (to be described later) is seated on and separated from the valve seat surface 12*d*. The valve seat surface 12*d* is formed so as to gradually increase in diameter upward.

An annular protruding portion 12*e* is formed on the outer peripheral edge of the flange portion 12*b* so as to protrude upward. The annular protruding portion 12*e* is in contact with the lower end of the second connection portion 15. The annular protruding portion 15*c* is inserted between the insertion portion 12*a* and the annular protruding portion 12*e*.

Valving Element

As shown in FIG. 3B, the valving element 13 is a metal member provided displaceably along the axial direction of the valve body 11. The valving element 13 has a shaft portion 13*a*, a spring bearing portion 13*b*, and a valve portion 13*c*. The spring bearing portion 13*b* is formed at the lower end of the shaft portion 13*a* by increasing the diameter, and supports the lower end of the return spring 18. The valve portion 13*c* is formed at the lower end of the spring bearing portion 13*b* by reducing the diameter, and is provided so as to be able to be seated on and separated from the valve seat surface 12*d*.

The shaft portion 13*a* is disposed so as to extend from the introduction hole 15*d* to the inside of the communication hole 17, and is formed so as to have an external diameter less than the internal diameters of the introduction hole 15*d* and the communication hole 17. A coil-shaped return spring 18 is provided on the outer peripheral side of the shaft portion 13*a*. The return spring 18 is engaged with the second stepped surface 15*h* at the upper end, and is engaged with the spring bearing portion 13*b* at the lower end. The return spring 18 urges the valving element 13 in a direction in which the valving element 13 is seated on the valve seat surface 12*d*.

The valve portion 13*c* is disposed in the introduction hole 15*d*. A seat portion 13*d* is formed on the outer peripheral surface of the valve portion 13*c*. The seat portion 13*d* is seated on and separated from the valve seat surface 12*d*. The seat portion 13*d* is tapered so as to gradually decrease in diameter downward.

Owing to such a configuration, when the intake negative pressure and the pressure of blow-by gas acting on the valving element 13 is less than the urging force of the return spring 18, the seat portion 13*d* of the valve portion 13*c* is seated on the valve seat surface 12*d* by the urging force of the return spring 18, and the communication between the hole portion 12*c* and the introduction hole 15*d* is shut off. As a result, blow-by gas is not led out from the PCV valve main body 1 to the PCV pipe 3.

On the other hand, when the intake negative pressure and the pressure of blow-by gas acting on the valving element 13 is greater than the urging force of the return spring 18, the valving element 13 moves upward against the urging force of the return spring 18, the seat portion 13*d* of the valve portion 13*c* is separated from the valve seat surface 12*d*, and the communication between the hole portion 12*c* and the introduction hole 15*d* is allowed. As a result, blow-by gas is led out through the introduction hole 15*d*, the communication hole 17, and the lead-out hole 14*a* to the PCV pipe 3.

Cover Member

As shown in FIG. 2, the cover member 2 is a resin member configured movably along the axial direction of the valve body 11 and rotatably about the axis of the valve body 11. The cover member 2 is a bottomed hollow cylindrical body that has a horizontally long elliptical shape in plan view and that is open at the lower end. The cover member 2 has an attachment portion 21 and a covering portion 22.

Attachment Portion

The attachment portion 21 is a portion that is fitted on the first connection portion 14 of the PCV valve main body 1. The attachment portion 21 is disposed closer to the second connection portion 15 than the PCV pipe 3. The attachment portion 21 has an attachment side upper wall portion 23, and an attachment side outer wall portion 24 suspended from the outer peripheral edge of the attachment side upper wall portion 23.

As shown in FIG. 3B, the attachment side upper wall portion 23 has an insertion hole 23*a* formed vertically therethrough. The first connection portion 14 is inserted into the insertion hole 23*a*. An protruding portion 23*b* is formed on the upper edge of the insertion hole 23*a* so as to protrude toward the PCV pipe 3. A reduced diameter portion 23*c* is formed on the inner peripheral surface of the insertion hole 23*a* so as to have a diameter less than the internal diameter of the protruding portion 23*b*.

Figure 7A:
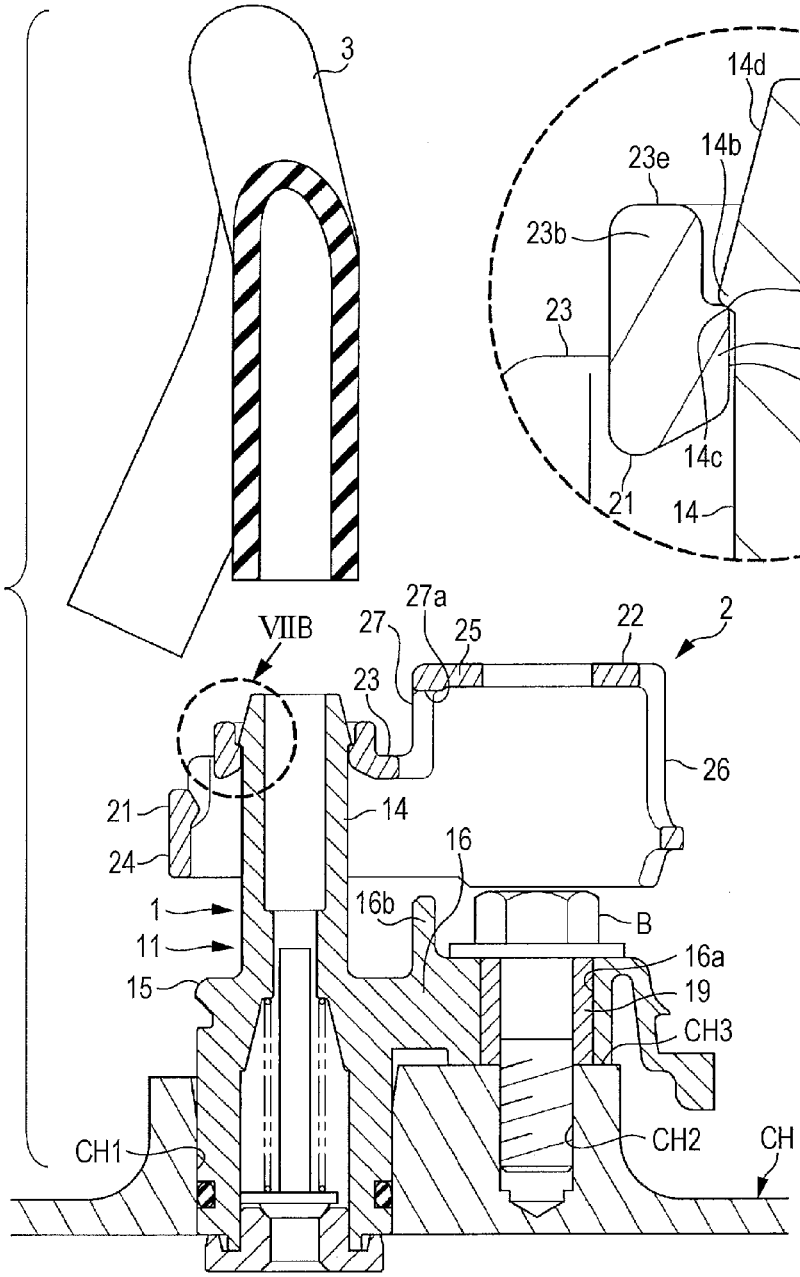
FIG. 7A is a longitudinal sectional view for illustrating the process of removing the PCV valve apparatus and PCV pipe.
Figure 7B:
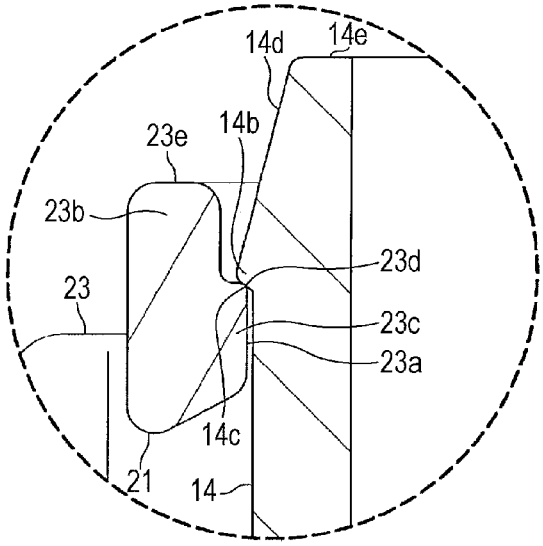
FIG. 7B is an enlarged view of part VIIB of FIG. 7A.

In this embodiment, as shown in FIG. 7B, the internal diameter of the reduced diameter portion 23*c* is less than the external diameter of the increased diameter portion 14*b*. Therefore, when the cover member 2 is moved toward the PCV pipe 3, the upper end corner 23*d* of the reduced diameter portion 23*c* comes into contact with the locked surface 14*c* of the increased diameter portion 14*b*, and the upward relative movement of the cover member 2 is restricted.

The internal diameter of the protruding portion 23*b* is greater than the external diameter of the increased diameter portion 14*b*. Therefore, when the upper end corner 23*d* of the reduced diameter portion 23*c* is in contact with the locked surface 14*c* of the increased diameter portion 14*b*, the upper end 23*e* of the protruding portion 23*b* is located above the increased diameter portion 14*b*. Thus, when a structure is used in which the upward relative movement of the cover member 2 is restricted, the PCV pipe 3 can be pushed up above the increased diameter portion 14*b* with the protruding portion 23*b*, and therefore the PCV pipe 3 can be removed from (pushed out of) the first connection portion 14.

Although, in this embodiment, the reduced diameter portion 23*c* is formed integrally with the attachment portion 21, the reduced diameter portion 23*c* may be formed separately from the attachment portion 21, and may be fixed to the attachment portion 21. Although, in this embodiment, an annular and single protruding portion 23*b* is formed, a plurality of protruding portions 23*b* may be formed in the circumferential direction of the insertion hole 23*a* at predetermined angular intervals. In this embodiment, when the upper end corner 23*d* of the reduced diameter portion 23*c* is in contact with the locked surface 14*c* of the increased diameter portion 14*b*, the upper end 23*e* of the protruding portion 23*b* is located below the upper end 14*e* of the first connection portion 14. However, the upper end 23*e* of the protruding portion 23*b* may be located above the upper end 14*e* of the first connection portion 14, or may be flush with the upper end 14*e* of the first connection portion 14.

As shown in FIG. 3B, the attachment side outer wall portion 24 is a portion extending substantially parallel to the axial direction of the valve body 11. The attachment side outer wall portion 24 is provided so as to surround the outer periphery of the second connection portion 15.

Covering Portion

As shown in FIG. 2, the covering portion 22 is a portion that is formed on the radially outer side of the attachment portion 21 continuously and integrally therewith and that covers the bolt B from above. The height dimension of the covering portion 22 is greater than the height dimension of the attachment portion 21. The covering portion 22 has a covering side upper wall portion 25, a covering side outer wall portion 26, and a stepped wall portion 27. The covering side outer wall portion 26 is suspended from the outer peripheral edge of the covering side upper wall portion 25. The stepped wall portion 27 connects the covering side upper wall portion 25 and the attachment side upper wall portion 23.

The covering side upper wall portion 25 is disposed above the attachment side upper wall portion 23. The covering side upper wall portion 25 has an opening 25*a* formed vertically therethrough. Therefore, the fastening state of the bolt B can be confirmed from the outside. The width dimension of the opening 25*a* is less than the maximum width dimension of the bolt B, and therefore the bolt B cannot be removed when covered by the covering portion 22.

The covering side outer wall portion 26 is a portion that is formed continuously and integrally with the attachment side outer wall portion 24 and that extends substantially parallel to the axial direction of the valve body 11. The covering side outer wall portion 26 is provided so as to surround the outer periphery of the fastened portion 16.

The attachment side outer wall portion 24 and the covering side outer wall portion 26 are provided so as to be in contact with or close to the outer peripheral surfaces of the second connection portion 15 and the fastened portion 16. Therefore, if one tries to rotate the cover member 2 about the axis of the valve body 11 with the covering portion 22 covering the bolt B, the attachment side outer wall portion 24 and the covering side outer wall portion 26 interfere (come into contact) with the second connection portion 15, the fastened portion 16, the bolt B, and so forth, and therefore the rotation of the cover member 2 is restricted.

Figure 5A:
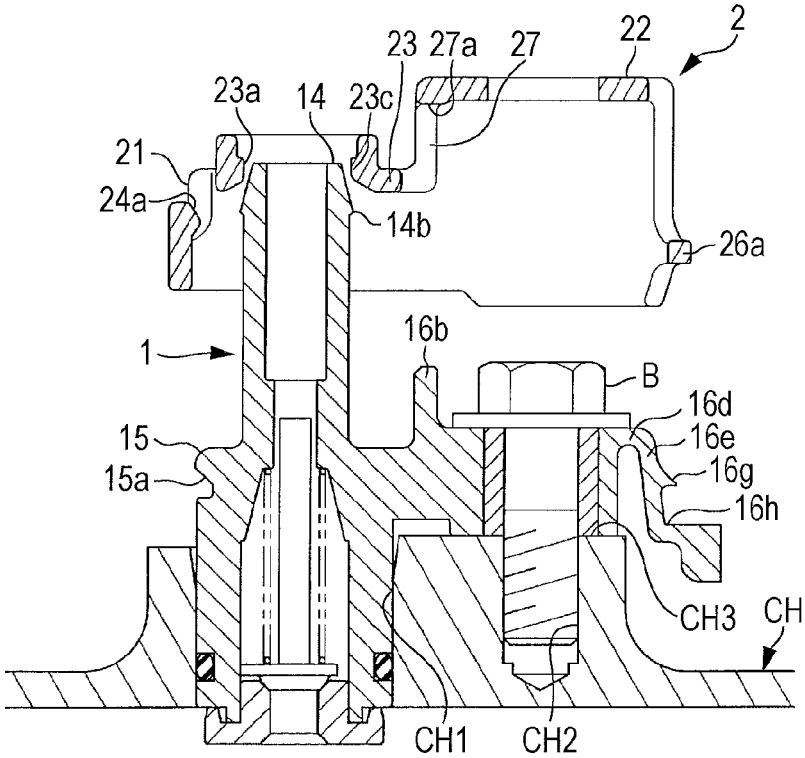
FIGS. 5A and 5B are longitudinal sectional views showing the process of attaching the cover member.
Figure 5B:
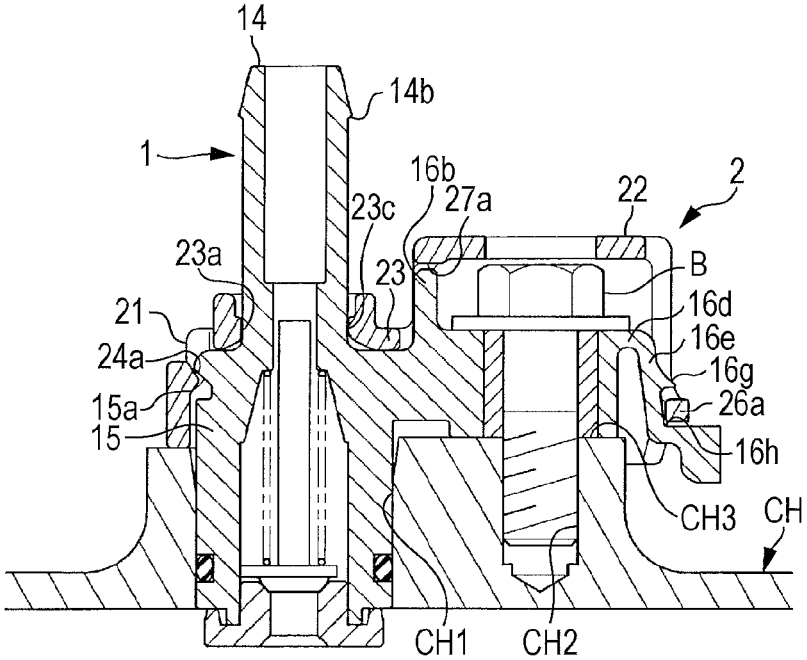

As shown in FIG. 5A, the stepped wall portion 27 is a portion extending substantially parallel to the axial direction of the valve body 11. The stepped wall portion 27 has a receiving portion 27*a* formed therein that is open downward (toward the locking portion 16*b*). The receiving portion 27*a* and the locking portion 16*b* are formed so as to face each other in the vertical direction. As shown in FIG. 5B, the receiving portion 27*a* is configured so as to be able to receive the locking portion 16*b* with the covering portion 22 covering the bolt B. Although the receiving portion 27*a* of this embodiment is formed radially through the stepped wall portion 27, the receiving portion 27*a* may have any configuration as long as it is open downward and can receive the locking portion 16*b*. For example, it is possible to secure a large thickness in the radial direction of the stepped wall portion 27, to cut a recess in the stepped wall portion 27 in the radial direction, and to use the recess (cutout) as the receiving portion 27*a*.

The first recess 15*a* and the first engaging portion 24*a*, and the engaging portion 16*c* and the second engaging portion 26*a* will now be described. As shown in FIG. 3B, the first recess 15*a* is formed by recessing a part of the second connection portion 15 radially inward. The first engaging portion 24*a* is formed so as to protrude radially inward from the inner peripheral surface of the upper end of the attachment side outer wall portion 24. In this embodiment, the first engaging portion 24*a* is inserted into and engaged with the first recess 15*a*, and the cover member 2 is thereby connected to the PCV valve main body 1.

As shown in FIG. 2, the engaging portion 16*c* is provided on the side of the bolt insertion hole 16*a* opposite to the locking portion 16*b*. As shown in FIG. 4, the engaging portion 16*c* has a continuous portion 16*d*, an extending portion 16*e*, a distal end portion 16*f*, and a protruding portion 16*g*. The continuous portion 16*d* protrudes radially outward from the outer peripheral surface of the upper end of the fastened portion 16. The extending portion 16*e* extends downward from the protruding end of the continuous portion 16*d*. The distal end portion 16*f* protrudes radially outward from the lower end of the extending portion 16*e*. The protruding portion 16*g* protrudes radially outward from the vertically middle part of the extending portion 16*e*. A second recess 16*h* is formed between the protruding portion 16*g* and the distal end portion 16*f*. The extending portion 16*e* is provided at a predetermined distance from the outer peripheral surface of the fastened portion 16.

A groove portion 26*b* is cut in the covering side outer wall portion 26. The engaging portion 16*c* is disposed in the groove portion 26*b*. The upper and lower ends of the groove portion 26*b* are open. A rod-like (square prism-like) second engaging portion 26*a* is formed in the covering side outer wall portion 26 in the circumferential direction so as to divide the groove portion 26*b* into upper and lower parts. In this embodiment, the second engaging portion 26*a* is inserted into and engaged with the second recess 16*h*, and the cover member 2 is thereby connected to the PCV valve main body 1.

The PCV valve apparatus 100 according to the embodiment of the present disclosure is basically configured as above. Next, attachment of the PCV valve main body 1 and the cover member 2 will be described with reference to FIGS. 5A and 5B. FIGS. 5A and 5B are longitudinal sectional views showing the process of attaching the cover member.

As shown in FIG. 5A, the PCV valve main body 1 is preliminarily fixed with the bolt B to the cylinder head cover CH, and then the cover member 2 is attached to the PCV valve main body 1. Specifically, the first connection portion 14 is inserted into the insertion hole 23*a* of the attachment portion 21, the covering portion 22 is disposed over the bolt B, and the cover member 2 is moved downward (toward the second connection portion 15). At this time, the reduced diameter portion 23*c* of the attachment portion 21 comes into contact with the increased diameter portion 14*b* of the first connection portion 14. Pressing down the attachment portion 21 elastically widens the reduced diameter portion 23*c*. The attachment portion 21 is further pressed down. After the reduced diameter portion 23*c* passes over the increased diameter portion 14*b*, the reduced diameter portion 23*c* returns to its original state.

Next, as shown in FIG. 5B, the cover member 2 is moved further downward, the locking portion 16*b* is received in the receiving portion 27*a*, the attachment side upper wall portion 23 is placed on the top of the second connection portion 15, and the attachment portion 21 is located at the lower end of the first connection portion 14. In this state, the PCV pipe 3 can be connected to the first connection portion 14.

During the downward movement of the cover member 2, the first engaging portion 24*a* of the attachment portion 21 comes into contact with the second connection portion 15. Pressing down the attachment portion 21 elastically widens the first engaging portion 24*a*. The attachment portion 21 is further pressed down. When the first engaging portion 24*a* reaches the first recess 15*a*, the first engaging portion 24*a* returns to its original state. The first engaging portion 24*a* is inserted into and engaged with the first recess 15*a*, and the cover member 2 is thereby connected to the PCV valve main body 1.

The second engaging portion 26*a* of the covering portion 22 comes into contact with the protruding portion 16*g*. Pressing down the covering portion 22 elastically widens the second engaging portion 26*a*, and bends the extending portion 16*e* radially inward with the continuous portion 16*d* as a base point, and as a result, the protruding portion 16*g* moves radially inward. The covering portion 22 is further pressed down. When the second engaging portion 26*a* reaches the second recess 16*h*, the second engaging portion 26*a* returns to its original state. The second engaging portion 26*a* is inserted into and engaged with the second recess 16*h*, and the cover member 2 is thereby connected to the PCV valve main body 1.

Figure 6:
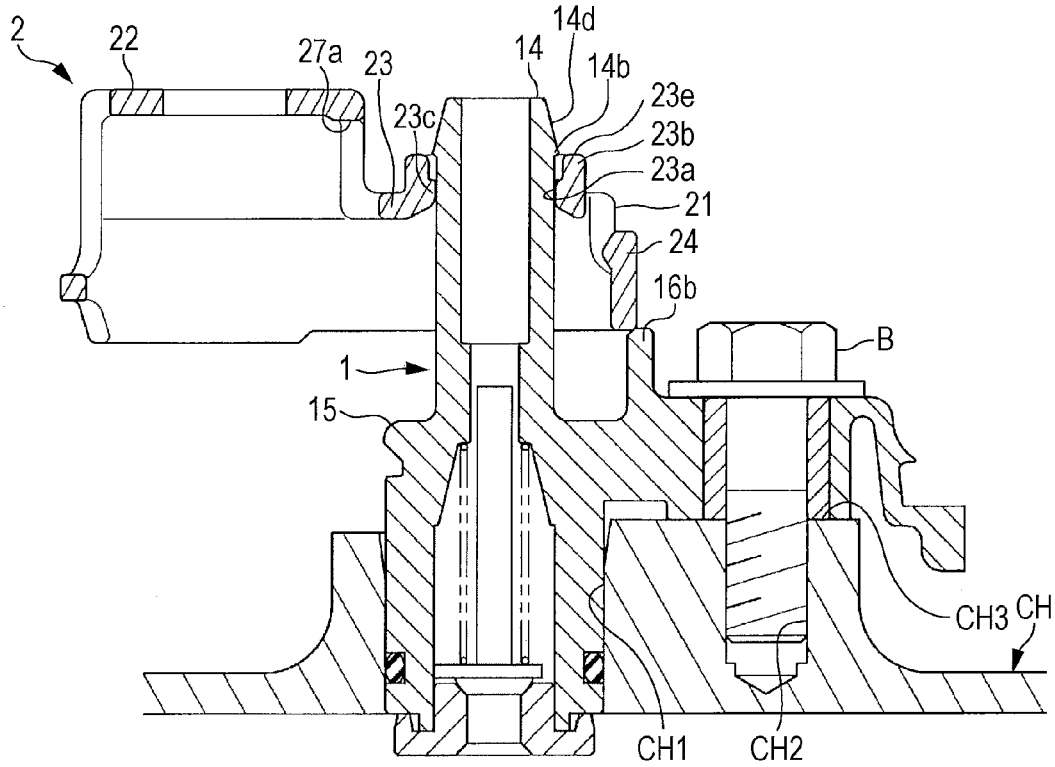
FIG. 6 is a longitudinal sectional view showing a state where the cover member is wrongly attached.

Next, a case where the cover member 2 is wrongly attached to the PCV valve main body 1 will be described with reference to FIG. 6. FIG. 6 is a longitudinal sectional view showing a state where the cover member is wrongly attached.

As shown in FIG. 6, when the first connection portion 14 is inserted into the insertion hole 23*a* of the attachment portion 21 and the covering portion 22 is not disposed over the bolt B (for example, when the covering portion 22 is disposed 180 degrees away from the bolt B), and when the cover member 2 is moved downward, the lower end of the attachment side outer wall portion 24 of the attachment portion 21 comes into contact with and is locked by the upper end of the locking portion 16*b*, and the downward relative movement of the attachment portion 21 is restricted. At this time, the attachment portion 21 is located at the upper end of the first connection portion 14, and the tapered surface 14*d* is located above the insertion hole 23*a* and the protruding portion 23*b* of the attachment portion 21. The upper end 23*e* of the protruding portion 23*b* is disposed at the same or substantially the same position as that of the increased diameter portion 14*b*. Therefore, if one tries to connect the PCV pipe 3 to the first connection portion 14, the first connection portion 14 cannot be fully inserted into the PCV pipe 3 owing to the attachment portion 21, and in addition, the PCV pipe 3 easily comes off the first connection portion 14 owing to the tapered surface 14*d*, and therefore the connection of the PCV pipe 3 to the first connection portion 14 is prevented. When the attachment side outer wall portion 24 comes into contact with and is locked by the locking portion 16*b*, the upper end 23*e* of the protruding portion 23*b* may be located above the increased diameter portion 14*b*.

Figure 8:
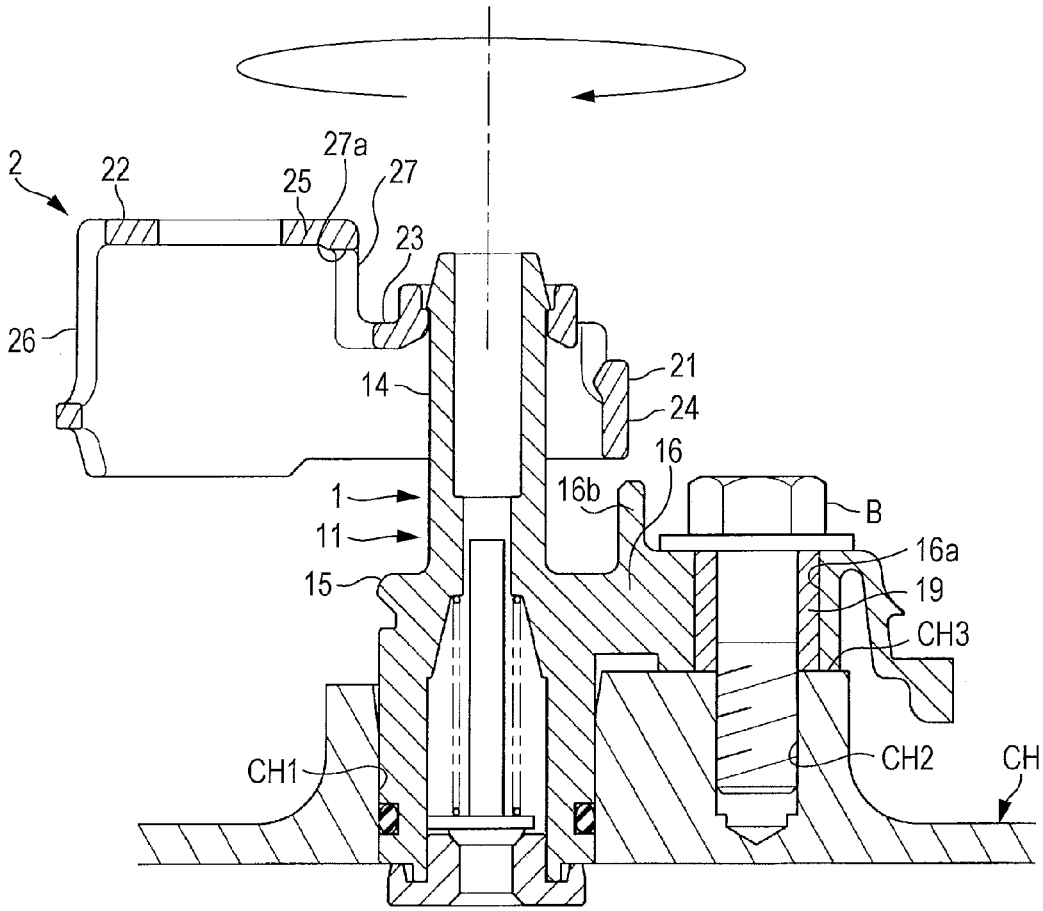
FIG. 8 is a longitudinal sectional view for illustrating the process of removing the PCV valve apparatus and PCV pipe.

Next, the removal of the PCV valve apparatus 100 and the PCV pipe 3 will be described with reference to FIG. 2, FIGS. 7A and 7B, and FIG. 8. FIG. 7A is a longitudinal sectional view for illustrating the process of removing the PCV valve apparatus and the PCV pipe, and FIG. 7B is an enlarged view of part VIIB of FIG. 7A. FIG. 8 is a longitudinal sectional view for illustrating the process of removing the PCV valve apparatus and the PCV pipe.

As shown in FIG. 2 and FIG. 7A, when the cover member 2 is moved upward (toward the PCV pipe 3), the PCV pipe 3 is pressed up by the protruding portion 23*b* of the cover member 2 and moves along the first connection portion 14. When the attachment portion 21 reaches the upper end of the first connection portion 14, the PCV pipe 3 comes off the first connection portion 14. At this time, as shown in FIG. 7A, the attachment side outer wall portion 24 and the covering side outer wall portion 26 are located in positions where they do not interfere with the locking portion 16*b*, the second connection portion 15, the fastened portion 16, and the bolt B, and therefore the cover member 2 can be rotated about the axis of the valve body 11.

Next, as shown in FIG. 8, the cover member 2 is rotated about the axis of the valve body 11 so that the covering portion 22 is moved from the position over the bolt B, and the bolt B is exposed. The bolt B is removed, and the PCV valve main body 1 is removed from the cylinder head cover CH. At this time, in this embodiment, the upper end corner 23*d* of the reduced diameter portion 23*c* comes into contact with the locked surface 14*c* of the increased diameter portion 14*b* (see FIG. 7B), and the cover member 2 is locked by the increased diameter portion 14*b*, and therefore the upward relative movement of the cover member 2 is restricted. Therefore, the PCV valve main body 1 and the cover member 2 are integrally removed from the cylinder head cover CH.

According to the embodiment described above, as shown in FIG. 2, in a covering position where the covering portion 22 covers the bolt B, the locking portion 16*b* is received in the receiving portion 27*a*, and the attachment portion 21 is located at the lower end of the first connection portion 14, and as shown in FIG. 6, in a non-covering position where the covering portion 22 does not cover the bolt B, the attachment portion 21 is in contact with and locked by the locking portion 16*b* and is located at the upper end of the first connection portion 14. Therefore, if the cover member 2 is wrongly attached to the PCV valve main body 1 such that the covering portion 22 does not cover the bolt B, the connection of the PCV pipe 3 to the first connection portion 14 is prevented by the attachment portion 21. Thus, the wrong attachment of the cover member 2 can be prevented, and the PCV valve apparatus 100 can be removed from the cylinder head cover CH with the PCV pipe 3 separated from the PCV valve apparatus 100. In particular, according to this embodiment, as shown in FIG. 6, a tapered surface 14*d* that gradually decreases in diameter upward is formed on the outer periphery of the upper end of the first connection portion 14, and the tapered surface 14*d* is located above the insertion hole 23*a* and the protruding portion 23*b* of the attachment portion 21 in the non-covering position, and therefore, if the cover member 2 is wrongly attached to the PCV valve main body 1, the PCV pipe 3 easily comes off the first connection portion 14 owing to the tapered surface 14*d*, and the wrong attachment of the cover member 2 can be prevented more effectively.

According to this embodiment, as shown in FIGS. 7A and 7B, when the cover member 2 is moved upward, the upper end corner 23*d* of the reduced diameter portion 23*c* comes into contact with the locked surface 14*c* of the increased diameter portion 14*b*, and the upward relative movement of the cover member 2 is restricted. That is, the cover member 2 is locked by the increased diameter portion 14*b* so as not to come off the first connection portion 14. Therefore, the cover member 2 can be reliably prevented from coming off the PCV valve main body 1, and therefore one is less likely to forget to attach the cover member 2 to the PCV valve main body 1, and the product reliability improves.

According to this embodiment, as shown in FIGS. 7A and 7B, the protruding portion 23*b* protrudes from the upper edge of the insertion hole 23*a* toward the PCV pipe 3, and therefore the PCV pipe 3 can be reliably pushed out with the protruding portion 23*b*, and the cover member 2 is located closer to the second connection portion 15 by the length of the protruding portion 23*b*, and therefore the cover member 2 is less likely to come off the PCV valve main body 1. Therefore, one is less likely to forget to attach the cover member 2 to the PCV valve main body 1, and the product reliability improves.

According to this embodiment, as shown in FIGS. 7A and 7B, the inclination of the cover member 2 to the first connection portion 14 can be restricted with the protruding portion 23*b*, and therefore the covering portion 22 cannot be moved to a position where the bolt B is exposed unless the cover member 2 is reliably moved along the first connection portion 14 toward the PCV pipe 3. Therefore, the bolt B can be prevented from being exposed from the covering portion 22 with the PCV pipe 3 connected.

Although the embodiment of the present disclosure has been described with reference to the drawings, the present disclosure is not limited to this, and various changes may be made without departing from the scope of the present disclosure.

In this embodiment, a description has been given taking an example of an automotive engine E. However, it goes without saying that the internal combustion engine according to the present disclosure is applicable to engines other than automotive engines, for example, engines for ships and general-purpose machines.

Although a description has been given of a case where the PCV valve apparatus 100 is fixed to the upper surface CH3 of the cylinder head cover CH, the present disclosure is not limited to this. The PCV valve apparatus 100 may be fixed to the side of the cylinder head cover CH, or may be fixed to the cylinder head, the cylinder block, or the like.

In an aspect of the embodiment, a PCV valve apparatus connected to a PCV pipe leading blow-by gas to an intake system and detachably fixed to an internal combustion engine main body by a fastening member, includes a PCV valve main body having a first connection portion inserted into the PCV pipe with its first end first, a second connection portion provided at a second end of the first connection portion and connected to the internal combustion engine main body, and a fastened portion protruding from the outer surface of the second connection portion in a direction intersecting with the second connection portion and fixed to the internal combustion engine main body by the fastening member, and a cover member having an attachment portion provided with an insertion hole into which the first connection portion is inserted and disposed closer to the second connection portion than the PCV pipe, and a covering portion covering the fastening member. The cover member is configured such that when the covering portion is moved along the first connection portion to a position where the fastening member can be removed, the attachment portion pushes the PCV pipe out of the first connection portion. The fastened portion is provided with a locking portion protruding toward the cover member. The covering portion is provided with a receiving portion capable of receiving the locking portion. In a covering position where the covering portion covers the fastening member, the locking portion is received in the receiving portion, and the attachment portion is located at the second end of the first connection portion. In a non-covering position where the covering portion does not cover the fastening member, the attachment portion is in contact with and locked by the locking portion and is located at the first end of the first connection portion.

The fastened portion according to the embodiment is provided with a locking portion protruding toward the cover member. The covering portion is provided with a receiving portion capable of receiving the locking portion. In a covering position where the covering portion covers the fastening member, the locking portion is received in the receiving portion, and the attachment portion is located at the second end of the first connection portion. In a non-covering position where the covering portion does not cover the fastening member, the attachment portion is in contact with and locked by the locking portion and is located at the first end of the first connection portion. Therefore, if the cover member is wrongly attached to the PCV valve main body such that the covering portion does not cover the fastening member, the connection of the PCV pipe to the first connection portion is prevented by the attachment portion. Thus, the wrong attachment of the cover member can be prevented, and the PCV valve apparatus can be removed from the internal combustion engine main body with the PCV pipe separated from the PCV valve apparatus.

It is preferable that a tapered portion that gradually decreases in diameter with distance from the second connection portion be formed on the outer peripheral surface of the first end of the first connection portion, and the tapered portion be located closer to the PCV pipe than the insertion hole of the attachment portion in the non-covering position.

According to this configuration of the embodiment, a tapered portion that gradually decreases in diameter with distance from the second connection portion is formed on the outer peripheral surface of the first end of the first connection portion, and the tapered portion is located closer to the PCV pipe than the insertion hole of the attachment portion in the non-covering position. Therefore, if the cover member is wrongly attached to the PCV valve main body, the first connection portion cannot be fully inserted into the PCV pipe owing to the attachment portion, and in addition, the PCV pipe easily comes off the first connection portion owing to the tapered portion. The connection of the PCV pipe to the first connection portion is thereby prevented, and therefore the wrong attachment of the cover member can be prevented more effectively.

It is preferable that an increased diameter portion having an external diameter greater than the internal diameter of the insertion hole of the attachment portion be formed on the outer peripheral surface of the first end of the first connection portion.

According to this configuration of the embodiment, the cover member is locked by the increased diameter portion of the first connection portion, and therefore the movement thereof is restricted. That is, the cover member is locked by the increased diameter portion so as not to come off the first connection portion. Therefore, the cover member can be reliably prevented from coming off the PCV valve main body, and therefore one is less likely to forget to attach the cover member to the PCV valve main body, and the product reliability improves.

It is preferable that the attachment portion have, on the edge of the insertion hole, a protruding portion protruding toward the PCV pipe.

According to this configuration of the embodiment, the protruding portion protrudes from the edge of the insertion hole toward the PCV pipe, and therefore the PCV pipe can be reliably pushed out with the protruding portion, and the cover member is located closer to the second connection portion by the length of the protruding portion, and therefore the cover member is less likely to come off the PCV valve main body. Therefore, one is less likely to forget to attach the cover member to the PCV valve main body, and the product reliability improves. The inclination of the cover member to the first connection portion can be restricted with the protruding portion, and therefore the covering portion cannot be moved to a position where the fastening member is exposed unless the cover member is reliably moved along the first connection portion toward the PCV pipe. Therefore, the fastening member can be prevented from being exposed from the covering portion with the PCV pipe connected.

According to the embodiment, a PCV valve apparatus that can prevent wrong attachment of a cover member can be provided.

Obviously, numerous modifications and variations of the present invention are possible in light of the above teachings. It is therefore to be understood that within the scope of the appended claims, the invention may be practiced otherwise than as specifically described herein.

What is claimed is:

1. A PCV valve apparatus comprising:

a PCV valve main body comprising:

a first connection portion comprising:

a first end to be provided in a PCV pipe provided to lead blow-by gas to an intake system; and a second end;

a second connection portion provided at the second end of the first connection portion to be connected to an internal combustion engine main body; and a fastened portion protruding from an outer surface of the second connection portion in a first direction to be fixed to the internal combustion engine main body by a fastening member, the first direction intersecting with the second connection portion; and a cover member comprising:

an attachment portion including an insertion hole in which the first connection portion is provided and which is disposed closer to the second connection portion than the PCV pipe; and a covering portion to cover the fastening member, the cover member being configured such that, when the covering portion is moved along the first connection portion to a position to remove the fastening member, the attachment portion pushes the PCV pipe out of the first connection portion, wherein the fastened portion includes a locking portion protruding toward the cover member in a state where the covering portion covers the fastening member, wherein the covering portion includes a receiving portion to receive the locking portion, wherein, in a covering position where the covering portion covers the fastening member, the locking portion is received in the receiving portion, and the attachment portion is located at the second end of the first connection portion, and wherein, in a non-covering position where the covering portion does not cover the fastening member, the attachment portion is in contact with the locking portion to be locked by the locking portion and is located at the first end of the first connection portion.

2. The PCV valve apparatus according to claim 1, wherein a tapered portion, that gradually decreases in diameter with respect to the distance from the second connection portion, is formed on an outer peripheral surface of the first end of the first connection portion, and wherein the tapered portion is located closer to the PCV pipe than the insertion hole of the attachment portion in the non-covering position.

3. The PCV valve apparatus according to claim 1, wherein an increased diameter portion having an external diameter greater than an internal diameter of the insertion hole of the attachment portion is formed on an outer peripheral surface of the first end of the first connection portion.

4. The PCV valve apparatus according to claim 1, wherein the attachment portion has a protruding portion provided on an edge of the insertion hole and protruding toward the PCV pipe in a state where the first end of the first connection portion is provided in the PCV pipe.

5. The PCV valve apparatus according to claim 1, wherein the first connection portion includes a lead-out hole which extends in a second direction and through which blow-by gas is to flow to the PCV pipe, wherein the second connection portion includes an introduction hole which extends in the second direction and through which blow-by gas is to flow to the lead-out hole from the introduction hole, and wherein the first direction intersects with the second direction.

6. The PCV valve apparatus according to claim 5, wherein the locking portion protrudes in the second direction.

7. The PCV valve apparatus according to claim 5, wherein the second end of the first connection portion is opposite to the first end of the first connection portion in the second direction.

* * * * *